United States Patent [19]

Bachot et al.

[11] 4,341,615

[45] Jul. 27, 1982

[54] DIAPHRAGM FOR ELECTROLYSIS AND PROCESS FOR THE PREPARATION THEREOF

[75] Inventors: Jean Bachot, Fontenay-aux-Roses; Jean Grosbois, L'Isle Adam, both of France

[73] Assignee: Chloe Chimie, Paris, France

[21] Appl. No.: 226,693

[22] Filed: Jan. 21, 1981

[30] Foreign Application Priority Data

Jan. 29, 1980 [FR] France ..... 80 01843

[51] Int. Cl.[3] ..... C25B 13/08; C25B 13/02

[52] U.S. Cl. ..... 204/296; 204/98; 204/301; 427/235; 429/247; 521/27

[58] Field of Search ..... 204/301, 296, 252; 429/247; 521/27

[56] References Cited

U.S. PATENT DOCUMENTS

| | | | |
|---|---|---|---|
| 3,291,632 | 12/1966 | Nielson | 177/54 |
| 3,694,281 | 9/1972 | Laduc | 156/77 |
| 3,887,499 | 6/1975 | Hodgoon, Jr. | 204/296 X |
| 4,057,481 | 11/1977 | Lee et al. | 204/296 |
| 4,113,912 | 9/1978 | Okita | 428/290 |
| 4,153,520 | 5/1979 | Fang | 204/98 |
| 4,178,218 | 12/1979 | Seko | 204/98 |
| 4,243,508 | 1/1981 | Dankese | 204/296 X |
| 4,255,240 | 3/1981 | Molnar et al. | 204/296 X |
| 4,292,146 | 9/1981 | Chang et al. | 204/98 |

FOREIGN PATENT DOCUMENTS 1295874 11/1972 United Kingdom .

*Primary Examiner*—F. Edmundson

[57] ABSTRACT

A wettable microporous diaphragm for electrolysis having a base of a fluorinated resin is disclosed. This diaphragm is prepared by depositing a copolymer of an unsaturated carboxylic acid and a non-ionic unsaturated monomer in the pores of the diaphragm. The diaphragm is particularly useful for the electrolysis of alkali metal chlorides.

2 Claims, No Drawings

DIAPHRAGM FOR ELECTROLYSIS AND PROCESS FOR THE PREPARATION THEREOF

BACKGROUND OF THE INVENTION

The present invention relates to a diaphragm for electrolysis which has a base of fluorinated resins and is of a marked hydrophilic character, as well as the method of preparing this diaphragm.

For some years, the conventional asbestos diaphragms for electrolysis, deposited on the cathodes of cells intended, in particular, for obtaining chlorine and sodium hydroxide, have been progressively replaced by diaphragms having a base of fluorinated resins optionally containing reinforcing fibers. Such diaphragms have numerous advantages due, in particular, to the chemical properties of the fluorinated resins, but they also have a substantial disadvantage, also inherent in these resins, of poor wettability. This defect is attenuated to some extent when fibers such as asbestos are incorporated in large proportions in the diaphragms, but the hazards associated with this material are well known.

Numerous solutions have been proposed to overcome this drawback. In addition to the use of special fillers such as oxides or hydroxides of titanium, zirconium, or aluminum or asbestos, introduction of groups containing sulfur, particularly sulfonic groups, either by treatment in situ of the resin used (described in U.S. Pat. No. 4,153,520) or by addition of previously sulfonated resin (described in French Pat. No. 2,152,988) has been suggested.

SUMMARY OF THE INVENTION

It has now been found that hydrophilic diaphragms, that is, diaphragms which are easily wetted by an electrolyte, can be obtained by a simple process which imparts to them properties which are favorable for electrolysis, particularly when in contact with concentrated caustic solutions.

It is an object of the present invention to provide a microporous diaphragm having a base of fluorinated resin particularly suitable for the electrolysis of alkali metal halide. The novel diaphragm is covered on at least a part of the inner surface of the pores with a copolymer of an unsaturated carboxylic acid and non-ionic unsaturated monomer.

It is another object of the present invention to provide a process for producing this diaphragm, which comprises forming a porous sheet having a base of fluorinated resin; impregnating said sheet with a mixture containing at least one unsaturated carboxylic acid, at least one non-ionic monomer, and at least one polymerization initiator, this mixture being of low viscosity; copolymerizing said mixture; and draining the sheet after impregnation and copolymerization of the comonomers contained in said sheet.

Other objects of the present invention will be apparent to those skilled in the art from the present description.

DETAILED DESCRIPTION OF THE INVENTION

The microporous sheet may be prepared by a variety of processes, many of which are well known today.

The fluorinated resins capable of use are polytetrafluoroethylene, polytrifluoroethylene, polyhexafluoropropylene, polyvinylfluoride, polyvinylidene fluoride, polyperfluoroalkoxy ethylene, the polyhaloethylenes comprising one or two chlorine atoms and two or three fluorine atoms on each ethylene unit (e.g., polychlorotrifluoroethylene), the corresponding polyhalopropylenes, and the copolymers of ethylene and/or propylene, and of at least partially fluorinated, halogenated unsaturated hydrocarbons having two or three carbon atoms. Among these compounds are those known under the TEFLON trademark of E. I. du Pont de Nemours and Company, Inc., the SOREFLON trademark of the Societe Produits Chimiques Ugine Kuhlmann, and the HALAR trademark of Allied Chemical Company.

These resins may be reinforced by various fibers, whether inorganic, such as fibers of asbestos, glass, quartz, zirconia, or carbon, or organic, such as fibers of polypropylene or polyethylene, optionally halogenated, for example, fluorinated polyhalovinylidene.

The proportion of reinforcing fibers is from zero to about 200 percent of the weight of the resin. When a relatively high proportion of asbestos is present, greater than 30 percent of the weight of resin, the diaphragm generally has sufficient wettability without additional treatment.

The total porosity should be from about 50 to 95 percent preferably, and the equivalent average diameter of the pores should be between about 0.1 and 12 micrometers, and preferably between about 0.2 and 6 micrometers. The equivalent diameter is the diameter of a theoretical cylindrical pore which permits the same speed of passage of a slightly viscous liquid under a given pressure as the actual pore does.

The carboxylic acid monomers used have one or two carboxyl groups. These may be acrylic and methacrylic acids and their halogen derivatives, phenylacrylic, ethylacrylic, maleic, itaconic, butyl-acrylic, vinylbenzoic acids, etc. Acrylic and methacrylic acids are preferred.

The non-ionic monomers may have a single ethylene bond, for example, styrene, methyl styrene, ethylvinylbenzene, the chloro- or fluoro-styrenes or methyl-styrenes, as well as vinyl pyridine or pyrrolidone. They may instead have several unsaturated bonds and also favor cross-linking of the layer of polymer formed, for example, the divinylbenzenes, preferably the para-isomer, trivinylbenzene, the divinylnaphthalenes, the divinylethyl or methyl benzenes, and trivinyl-1,3,4-cyclohexane.

It is preferred that both of at least one monounsaturated non-ionic monomer and a multi-unsaturated monomer be used. The ratio of the molecules or units of these two types of monomers should be between about 0.1 and 10 and preferably between about 0.4 and 2.5. Divinylbenzene/ethylvinylbenzene mixtures available commercially may be advantageously employed.

The weight proportion of unsaturated acid to the total of the carboxylic and non-ionic comonomers is between about 40 and 98 percent by weight and, preferably, between about 70 and 95 percent. It is important that this mixture of monomers, preferably containing a diluent, be of low viscosity (preferably less than 2 cp) so as to be able to penetrate under low vacuum (1 to 100 mm of mercury below atmospheric pressure) into the pores of the microporous substrate.

To control the quantity of monomers which are introduced and the dispersion within the pores, an inert diluent is added to the mixture of monomers, for example, methanol, ethanol, isopropanol, butanols, acetone, methyl isobutylketone, dioxane, chloro- or dibromomethane, aliphatic hydrocarbons (optionally halogenated) having 2 to 10 carbon atoms, dimethylformamide, dimethylacetamide, and dimethylsulfoxide. Ethanol is the preferred diluent. In general, the diluents should have a surface tension of relatively low value at room temperature and be miscible with the comonomers and desirably with water. For 100 parts by weight of comonomers, preferably 30 to 1600 parts of diluent are used. The copolymer formed from the comonomers which have been diluted in this manner will be present in an at least a monomolecular layer on at least a portion of the inner surface of the pores.

A radical polymerization initiator is added to the mixture of comonomers. It should not cause substantial polymerization at room temperature in the absence of activating radiation (ultraviolet), but should cause polymerization of the comonomers within a time of preferably less than 12 hours at a temperature less than that of the softening point of the fluorinated polymer used, and preferably less than 100° C. Benzoyl, lauroyl, t-butyl, and cumyl peroxides, t-butyl peracetate or perbenzoate, and azo-bis-iso-butyronitrile are useful as the polymerization initiators.

The temperature and polymerization conditions can be adapted to the choice of the diluent so as to avoid excessively rapid loss thereof during the polymerization in situ. For this, activators such as dimethylaniline may be used in combination with benzoyl peroxide to obtain polymerization at about 40° C.

The method of preparing these wettable microporous diaphragms comprises, in its first phase, the preparation of a microporous sheet. Among the methods preferred for this are those employing porophoric fillers, such as described in French Pat. Nos. 2,229,739; 2,280,435; 2,280,609; and 2,316,216; which are hereby incorporated herein by reference.

It is also possible to introduce a porophoric filler into a fluorinated resin latex (particularly one of polytetrafluoroethylene) containing a plasticizing agent, about 900 to 1200, and preferably about 400 to 900, parts by weight of porophores, about 0.5 to 2 parts of plasticizing agent, and about 1 to 20 parts of water being added to 100 parts of resin latex containing about 40 to 60 percent by weight solids. The next steps are mixing together the materials in a moderately agitated mixer, that is, one whose rotor is turning at less than 100 rpm, preforming a sheet by rolling using the paste obtained, drying it, and then sintering it at a temperature on the order of the melting point of the polymer used. The porophoric agent, which is preferably calcium carbonate, is then eliminated by immersion in acid, preferably acetic acid in an aqueous solution of about 15 to 20 percent by weight.

Porous sheets can also be obtained if the fluorinated polymer used is a copolymer of ethylene and chlorotrifluoroethylene or a polytetrafluoroethylene latex, associated with inorganic or organic fibers (asbestos, zirconia, fibrillated polyolefins), by dispersing the copolymer in an amount of about 5 to 50 percent of the weight of fibers in electrolyte containing about 15 percent sodium hydroxide and 15 percent sodium chloride to which a surface active agent is added.

This suspension is deposited on a surface which permits filtration; this surface may, in particular, be a perforated cathode. After removal of the water and drying, the sheet formed upon filtration is heated to 260° C., which temperature is maintained for a period of from about 30 minutes to 1 hour.

The porous sheet is then impregnated with a mixture of comonomers and polymerization initiator and, usually, inert diluent. The proportion of diluent is selected as a function of various other parameters, particularly the proportion of the cross-linking agent, comonomer (e.g., divinylbenzene) compared to the proportion of unsaturated carboxylic acids and the proportion of polymerization initiator (e.g., benzoyl peroxide). The various other parameters must be selected so that 0.1 to 6 percent of the total pore volume (before the copolymerization in situ) of the microporous support sheet is occupied by carboxylic copolymer. The proportion by weight of divinyl benzene, if used, may be between about 2.5 and 25 parts to 100 parts of unsaturated carboxylic acid. It is also advisable to use only small amounts of polymerization initiator, for instance, less than about 5 parts by weight of benzoyl peroxide to 100 parts by weight of comonomers, and little or no copolymerization accelerator, such as dimethylaniline (less than 2 parts).

This impregnation can be effected, for instance, by immersion of the porous sheet in a tank containing the liquid mixture and filtration under a vacuum of about 10 to 100 mm of mercury.

The sheet, possibly on a support and, in particular, on a cathode, is then introduced into an enclosure in which the temperature or actinic rays (e.g., ultraviolet rays) permit the action of the polymerization initiators. The sheet may be immersed in a liquid, for instance, water. It is important that the temperature is not too high, that is, generally less than about 150° C., and does not cause substantial modification of the structure of the microporous sheet due to excessively rapid evaporation of the diluent or destruction of the copolymer deposited. The polymerization time (which corresponds approximately to the half-life of the initiator used) is preferably less than about 12 hours. One preferred means of polymerization is immersion in water between about 40° C. and 100° C.

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

Table I, below, read with the following examples, clearly illustrates the influence of various factors on the loss of head of the electrolyte through the diaphragm during electrolysis or, in other words, the hydrostatic pressure due to the anolyte pressure necessary to assure sufficient percolation, and on the electric voltage in the cell. These factors include the porosity of the diaphragm and, which directly affect the porosity, the proportion of porophoric agent, the weight ratio between the carboxylic acids and the non-ionic monomers, and the quantity of diluent added. It will also be seen that the parameters may be chosen so as to achieve a given purpose.

EXAMPLE 1

700 grams of powdered calcium carbonate, commercial designation "CALIBRITE 1400," produced by the OMYA Company, and 42 grams of PEROLENE (PEROLENE S P Z) in aqueous solution of 62 grams per liter are introduced into 167 grams of a polytetrafluoroethylene latex of 60 percent dry extract, brand name "SOREFLON," produced by Produits Chimiques Ugine Kuhlmann. The mixture is homogenized for 5 minutes in a Werner mixer, the Z-shaped rotors of which turn at a speed of 45 rpm.

The paste obtained is formed into a sheet by means of a Lescuyer roll mixer. The thickness is reduced to 1.2 mm and the initial speed of rotation of the rolls of 15 rpm is gradually reduced to 5 rpm within about 2 to 4 minutes.

The sheet thus formed is dried for 15 hours at 90° C. and then for 2 hours at 120° C., and then sintered in a hot-air furnace, the temperature of which is increased at the rate of 100° C. per hour to 360° C., which final temperature is maintained for 15 minutes.

The calcium carbonate is eliminated by immersion for 72 hours in a 25 percent by weight aqueous acetic acid solution containing 2 grams per liter of fluorinated surface active agent of brand name ZONYL F.S.N., manufactured by E. I. du Pont de Nemours and Company, Inc. The diaphragm is rinsed with water and immersed for 12 hours in ethanol.

The following solution is then filtered through the microporous diaphragm under a vacuum of 50 mm mercury (parts by weight):

| | |
|---|---|
| ethanol | 300 parts |
| methacrylic acid | 100 parts |
| commercial divinylbenzene | 10 parts |
| benzoyl peroxide | 2 parts |

The commercial divinyl benzene contains 45 percent by weight ethylvinylbenzene and 55 percent divinylbenzene. Copolymerization is brought about by immersion for 2 hours in water at 80° C.

This diaphragm, to which a remarkable wettability has been imparted, is kept in water until it is used. It is then placed in the known manner in contact with a cathode (screen of iron wires manufactured by the Gantois Cy.) in an electrolysis cell. The anode consists of expanded titanium covered with Pt-Ir alloy. The interelectrode distance is 5.5 mm and is maintained by a rubber gasket. The electrolyte introduced into the anode compartment is a brine of 300 grams per liter of sodium chloride.

After 200 hours of operation, the operating conditions then being stable, the temperature is 85° C., the current density is 25 amperes per square decimeter, the electric voltage is 3.35 V, and the electrolyte head is 40 cm. The sodium hydroxide of the catholyte has a concentration of 123 grams per liter and the Faradic efficiency (OH ion) is 94 percent.

COMPARATIVE EXAMPLE

A microporous diaphragm prepared in the manner indicated above, with the exception of the treatment with the comonomers of carboxylic acid and non-ionic monomers, is used under the same conditions as in Example 1.

After 15 hours of operation, the voltage rises to 4.0 volts and the head increases to 60 cm. It then increases very rapidly and the electrolysis must be stopped.

EXAMPLE 2

The procedure of Example 1 is repeated varying the amount of calcium carbonate and the proportion of comonomers, diluent, and peroxide in the impregnation mixture. The data for these runs are set forth in Table I, below, in which:

AM=methacrylic acid;

DVB=commercial mixture of 55 percent by weight of divinylbenzene and 45 percent ethylvinylbenzene; and PB=benzoyl peroxide.

The results given were obtained after 200 hours of operation, unless otherwise indicated. The first two control tests (1 and 2) had to be stopped after 25 hours, which is the time when the measurements of the head "h" (in cm) and voltage "U" (in Volts) were taken. The same is true of test 235.

The figures concerning the materials used are parts by weight, except that those for calcium carbonate are those required for 100 parts of fluorinated polymer (dry). The electrolyte head "h" is the hydrostatic pressure on the diaphragm expressed in centimeters or the height of electrolyte of a density of about 1.2 multiplied by this last figure. The amount of NaOH is expressed in grams per liter. The yield "R(OH)%" is the Farad yield calculated on the basis of the sodium hydroxide formed. "T%" is the percentage of the pore volume occupied by the dry polymer.

TABLE I

| | $CaCO_3$ by | Composition of the mixture by weight | | | | Electrolysis | | | | |
|---|---|---|---|---|---|---|---|---|---|---|
| | weight | Ethanol | AM | DVB | PB | U | h | NaOH | R(OH) % | T % |
| Control 1 | 500 | 0 | 0 | 0 | 0 | 5.0↑ | >50 | — | — | 0 |
| 235 | " | 1500 | 100 | 10 | 2 | 4.25 | >50 | — | — | 0.1 |
| 229 | " | 330 | " | " | " | 4.15 | >50 | 128 | 97.98 | 0.8 |
| 223 | " | 80 | " | " | " | 3.90 | >50 | 130 | 98.99 | 3 |
| 253 | " | 1500 | 100 | 30 | 2 | 4.5 | >50 | — | — | 0.1 |
| 247 | " | 330 | " | " | " | 4.1 | >50 | 140 | 95 | 2.8 |
| Control 2 | 700 | 0 | 0 | 0 | 0 | 4.0↑ | >50↑ | — | — | 0 |
| 237 | " | 1500 | 100 | 10 | 2 | 3.80 | 42 | 129 | 94 | 0.15 |
| 221 | " | 330 | " | " | " | 3.35 | 40 | 120/125 | 94 | 1.5 |
| 225 | " | 80 | " | " | " | 3.60 | 32 | 127 | 94 | 5 |
| 255 | " | 1500 | 100 | 30 | 2 | 3.55 | 50 | 125/130 | 94 | 0.1 |
| 249 | " | 330 | " | " | " | 3.80 | 26 | 130 | 94 | 3.5 |
| 249* | " | 330 | " | " | " | 3.65 | 24 | 132 | 94 | 5 |
| Control 3 | 900 | 0 | 0 | 0 | 0 | 3.60↑ | 25↑ | 100 | 94 | 0 |
| 239 | " | 1500 | 100 | 10 | 2 | 3.51 | 23 | 100 | 94 | 0.6 |
| 223 | " | 330 | " | " | " | 3.33 | 18 | 100 | 34 | 2 |
| 227 | " | 80 | " | " | " | 3.45 | 6 | 114 | 94 | 4.5 |
| 257 | " | 1500 | 100 | 30 | 2 | 3.50 | 11 | 90 | 94 | 0,2 |

TABLE I-continued

| | $CaCO_3$ by weight | Composition of the mixture by weight | | | | Electrolysis | | | | |
|---|---|---|---|---|---|---|---|---|---|---|
| | | Ethanol | AM | DVB | PB | U | h | NaOH | R(OH) % | T % |
| 251 | " | 330 | " | " | " | 3.59 | 7 | 100 | 94 | 4 |

*Addition of one part of dimethyl aniline and polymerization in water at 40° C. instead of 80° C.

The terms and expressions which have been employed are used as terms of description and not of limitation, and there is no intention in the use of such terms and expressions of excluding any equivalents of the features shown and described or portions thereof, and it should be recognized that various modifications are possible within the scope of the invention claimed.

We claim:

1. A porous hydrophilic diaphragm having a base of fluorinated polymers for electrolysis, characterized by the fact that it is microporous and covered on at least a part of the inner surface of its pores with a copolymer of unsaturated carboxylic acid and non-ionic unsaturated monomer, the porosity being from about 50 to about 95 percent, the equivalent average diameter of the pores being from about 0.1 to about 12 micrometers, and 0.1 to 6 percent of the pore volume being occupied by dry polymer.

2. A porous diaphragm according to claim 1, characterized by the fact that the copolymer present in the pores is a copolymer of an acid selected from the group consisting of acrylic and methacrylic acids and of at least two non-ionic monomers, at least one being selected from the group consisting of styrene and ethylvinylbenzene and the other being divinylbenzene.

* * * * *